US006085488A

United States Patent [19]

Turfan et al.

[11] Patent Number: 6,085,488

[45] Date of Patent: Jul. 11, 2000

[54] FILM CARRIAGE RING FOR HORIZONTAL STRETCH FILM WRAPPING OR PACKAGING MACHINES, AND A METHOD OF MAKING THE SAME

[75] Inventors: Faruk M. Turfan, Brossard; Stephen G. Forrest, Montreal, both of Canada

[73] Assignee: Illinois Tool Works Inc., Glenview, Ill.

[21] Appl. No.: 09/216,649

[22] Filed: Dec. 18, 1998

[51] Int. Cl.[7] ..... B65B 11/00

[52] U.S. Cl. ..... 53/396; 53/588; 53/210

[58] Field of Search ..... 53/588, 210, 396

[56] References Cited

U.S. PATENT DOCUMENTS

| | | | |
|---|---|---|---|
| 4,110,957 | 9/1978 | Lancaster et al. . | |
| 4,317,322 | 3/1982 | Lancaster et al. . | |
| 4,524,568 | 6/1985 | Lancaster et al. . | |
| 4,549,388 | 10/1985 | Lancaster . | |
| 4,553,374 | 11/1985 | Lancaster et al. . | |
| 4,756,143 | 7/1988 | Lancaster | 53/588 X |
| 4,953,336 | 9/1990 | Lancaster, III et al. . | |
| 5,216,871 | 6/1993 | Hannen | 53/588 X |
| 5,517,807 | 5/1996 | Morantz | 53/588 X |
| 5,768,862 | 6/1998 | Mauro | 53/588 X |

OTHER PUBLICATIONS

ITW MIMA, Horizontal Series, Stretch Wrapping Systems.

*Primary Examiner*—Linda Johnson
*Attorney, Agent, or Firm*—Schwartz & Weinrieb

[57] ABSTRACT

A composite ring member comprises an annular ring member and an annular reinforcing ring member welded to the external peripheral portion of the annular ring member. The annular ring member comprises a tubular stock member, having a substantially rectangular or square-shaped cross-sectional configuration, which is bent into the form of the annular ring member and the free end portions thereof are welded together. In this manner, excessive waste of material in forming conventional ring members, wherein such conventional ring members are cut out from square plates, is eliminated. Segmentally-configured gusset plate members are welded to diametrically opposite internal peripheral portions of the annular ring member so as to respectively support a film roll carriage and dispensing assembly and a counterbalancing mechanism.

21 Claims, 3 Drawing Sheets

FILM CARRIAGE RING FOR HORIZONTAL STRETCH FILM WRAPPING OR PACKAGING MACHINES, AND A METHOD OF MAKING THE SAME

FIELD OF THE INVENTION

The present invention relates generally to film wrapping or packaging machines, and more particularly to a new and improved film carriage support ring, for use within horizontal stretch film wrapping or packaging machines, and a method of making the same.

BACKGROUND OF THE INVENTION

Film wrapping or packaging machines are of course well known and comprise two different primary types of machines. A first primary type of film wrapping or packaging machine is the vertical type packaging or wrapping machine wherein a ring member, upon which a roll of stretch film wrapping material is mounted by means of a suitable carriage having a dispensing mechanism or tensioning assembly incorporated therein, is rotated around a vertical axis. The ring member, as well as the carriage, the roll of stretch film wrapping material, and the stretch film dispensing and tensioning mechanism mounted upon the ring member, are also mounted upon a vertically reciprocable frame member which, in turn, is movably mounted upon and within a fixed structural framework.

Accordingly, when it is desired to wrap an article to be packaged or wrapped, wherein the article is disposed, for example, at a fixed wrapping station defined within the fixed structural framework, the ring member is rotated in a substantially horizontal plane and about its vertical axis, while being simultaneously moved in the vertical direction by means of the vertically reciprocable frame member, whereby the roll of stretch film wrapping material, mounted upon the rotatable ring member by means of the carriage assembly, encircles and completely wraps or envelops the article within the film wrapping or packaging material.

The second primary type of film wrapping or packaging machine is the horizontal type packaging or wrapping machine wherein such machines are often used to wrap or package, among other types or articles to be packaged or wrapped, substantially elongated loads which would otherwise be difficult to wrap or package if the vertical type of wrapping or packaging machine was employed. In the horizontal type packaging or wrapping machine, a ring member, upon which a roll of stretch film wrapping material is mounted by means of a suitable carriage having a dispensing mechanism or tensioning assembly incorporated therein, is rotated around a horizontal axis. The ring member is usually axially stationary and a first conveyor is operatively associated therewith so as to move the article to be wrapped through the interior open-space portion of the ring member which thereby in effect defines a wrapping station therewithin.

Accordingly, when the roll of stretch film wrapping material, mounted upon the carriage, is rotated around the ring member as a result of the carriage and ring member being rotated about the horizontal axis of the ring member, the wrapping material is wrapped around the article and part of the first conveyor. The first conveyor continuously moves the article through the wrapping station defined by means of the ring member, and the downstream end of the wrapped or packaged article is transferred to a second conveyor which effectively and ultimately removes the entire wrapped or packaged article from the first conveyor whereupon the stretch film wrapping material is released from its enveloping position with respect to the first conveyor and effectively contracts, due to its elastic memory, in a tensioned state upon the article so as to thereby properly wrap or package the article. Horizontal type packaging or wrapping machines are exemplified by means of U.S. Pat. No. 4,953,336 which issued on Sep. 4, 1990 to Lancaster, III et al., U.S. Pat. No. 4,553,374 which issued on Nov. 19, 1985 to Lancaster et al., U.S. Pat. No. 4,549,388 which issued on Oct. 29, 1985 to Lancaster, U.S. Pat. No. 4,524,568 which issued on Jun. 25, 1985 to Lancaster et al., U.S. Pat. No. 4,317,322 which issued on Mar. 2, 1982 to Lancaster et al., and U.S. Pat. No. 4,110,957 which issued on Sep. 5, 1978 to Lancaster et al.

In connection with the fabrication or manufacture of the ring members of the horizontal type packaging or wrapping machines, the ring members are conventionally manufactured as annular ring members or components which are cut out from substantially large, flat, square-shaped planar sheets or plates. A typically conventional film carriage ring for use within horizontal stretch-type film wrapping or packaging machines and fabricated or manufactured in accordance with the afore-noted techniques is illustrated, for example, in FIGS. 1–3. The film carriage ring is generally indicated by the reference character 10 and is seen to comprise an annular ring member 12 around the outer periphery of which there has been welded a reinforcing flange member 14. The annular ring member 12 has been severed or cut out from a substantially square-shaped steel plate 16, which is indicated in phantom lines simply for illustrative purposes and understanding of the fabrication or manufacturing techniques, and accordingly, it can be readily appreciated that as a result of the severing and removal of the annular ring member 12 from the steel plate 16, corner regions 18 of the steel plate 16, as well as the substantially large residual central region 20 of the steel plate 16, are entirely wasted.

It is to be noted that the surrounding reinforcing flange member 14 is welded onto the external periphery of the annular ring member 12 subsequent to the severing and removal of the annular ring member 12 from the steel plate 16. In addition, a first annular region, as illustrated in FIG. 1, of the annular ring member 12 is provided with a plurality of apertures 22 within which fasteners, not shown, can be disposed so as to mount the film wrapping material carriage assembly, also not shown, upon the ring member 12, and a plurality of apertures 24 are provided within a second annular region, located diametrically opposite the first annular region, within which additional fasteners, not shown, can be disposed so as to mount a suitable device or mechanism upon the ring member 12 so as to counterbalance the presence and weight of the film wrapping material carriage.

A need therefore exists in the art for a new and improved film carriage ring which can be utilized in connection with horizontal-type stretch film packaging or wrapping machines, which can be easily and readily manufactured or fabricated, and which does not result in the substantial waste of material as is characteristic of the conventionally constructed, manufactured or fabricated ring members used within current horizontal-type stretch film packaging or wrapping machines.

OBJECTS OF THE INVENTION

Accordingly, it is an object of the present invention to provide a new and improved film carriage ring for horizontal stretch-type film wrapping or packaging machines.

Another object of the present invention is to provide a new and improved film carriage ring for horizontal stretch-type film wrapping or packaging machines wherein the ring member thereof can be simply and readily manufactured without exhibiting the manufacturing drawbacks or disadvantages characteristic of the PRIOR ART ring members and the manufacturing or fabrication techniques thereof.

An additional object of the present invention is to provide a new and improved film carriage ring for horizontal stretch-type film wrapping or packaging machines wherein the ring member thereof can be simply and readily manufactured in a substantially economical manner.

A further object of the present invention is to provide a new and improved film carriage ring for horizontal stretch-type film wrapping or packaging machines wherein the ring member thereof can be simply and readily manufactured in accordance with fabrication or manufacturing techniques whereby the substantial waste of material, characteristic of the PRIOR ART fabrication or manufacturing techniques, is effectively eliminated or substantially reduced.

SUMMARY OF THE INVENTION

The foregoing and other objects are achieved in accordance with the teachings of the present invention through the provision of a new and improved film carriage ring for horizontal stretch-type film wrapping or packaging machines wherein the new and improved film carriage ring comprises an annular ring member which is formed from a tubular steel stock member having a substantially square-shaped cross-sectional configuration. A predetermined length of the tubular steel stock member is mounted within a suitable fixture, and the free ends of the tubular steel stock member are then welded together so as to form the tubular steel stock member into an annular steel box-ring member. A reinforcing steel plate is subsequently welded upon the outer periphery of the annular steel box-ring member, and a pair of gusset members are welded upon diametrically opposite inner peripheral portions of the steel box-ring member. One of the gusset members serves to mount the film roll carriage and dispensing assembly thereon, while the other one of the gusset members serves to mount a suitable mechanism or weight thereon for counterbalancing the film roll carriage and dispensing assembly.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 3:
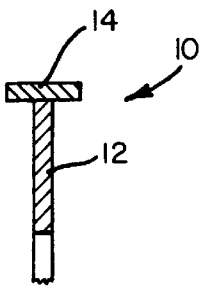
FIG. 3 PRIOR ART
FIG. 3 is a cross-sectional view of the PRIOR ART ring member shown in FIG. 1 as taken along the lines 3—3 of FIG. 1.
Figure 2:
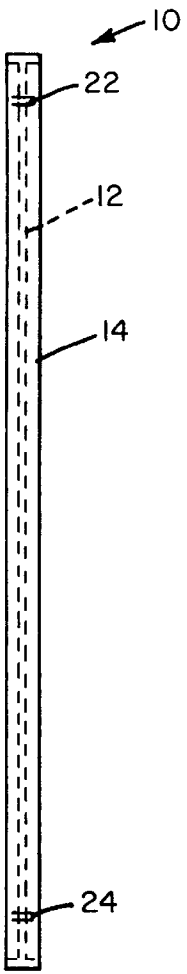
FIG. 2 PRIOR ART
FIG. 2 is a side elevational view of the PRIOR ART ring member shown in FIG. 1.
Figure 1:
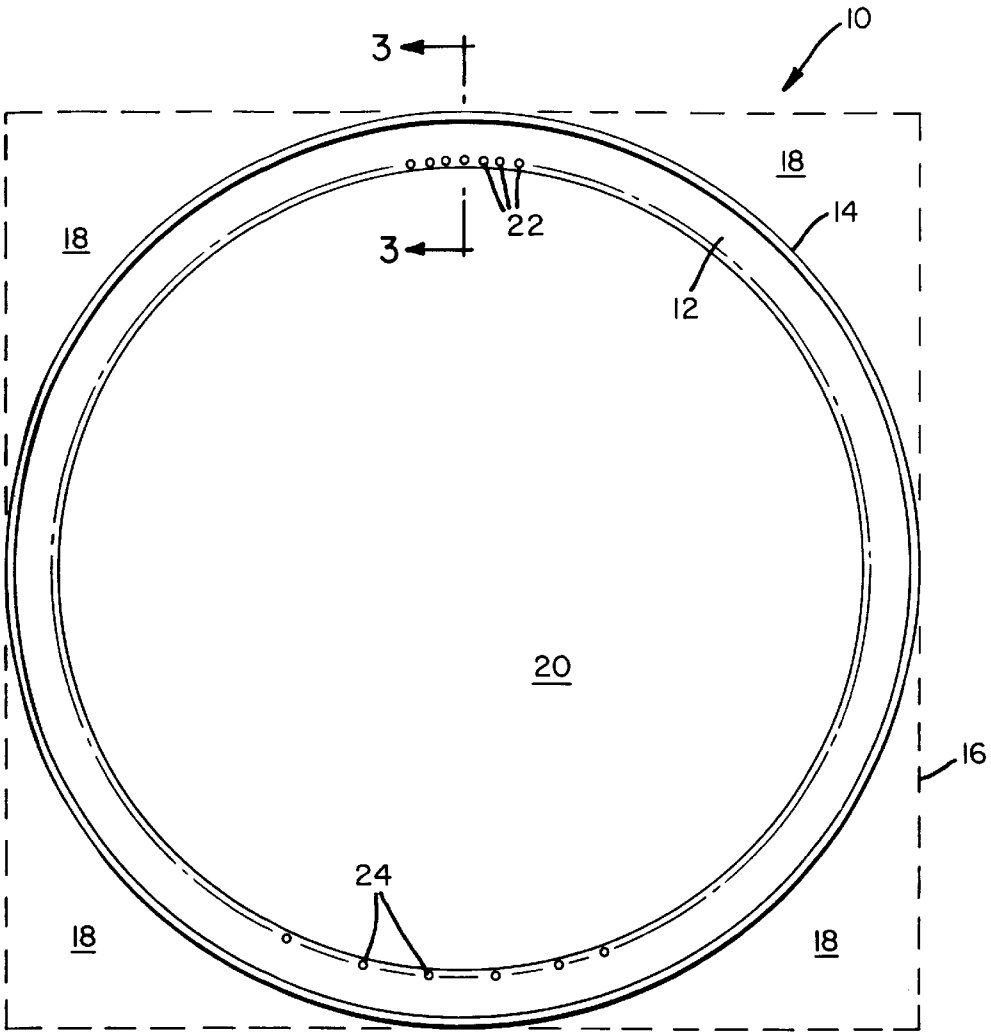
FIG. 1 PRIOR ART
FIG. 1 is a front elevational view of a conventional PRIOR ART ring member currently used within horizontal-type stretch film wrapping or packaging machines.
Figure 5:
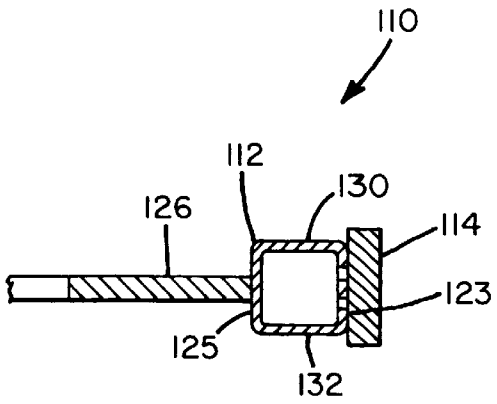
FIG. 5 is a cross-sectional view similar to that of FIG. 3 showing, however, the cross-sectional structure of the new and improved ring member of FIG. 4 as taken along the lines 5—5 of FIG. 4.
Figure 4:
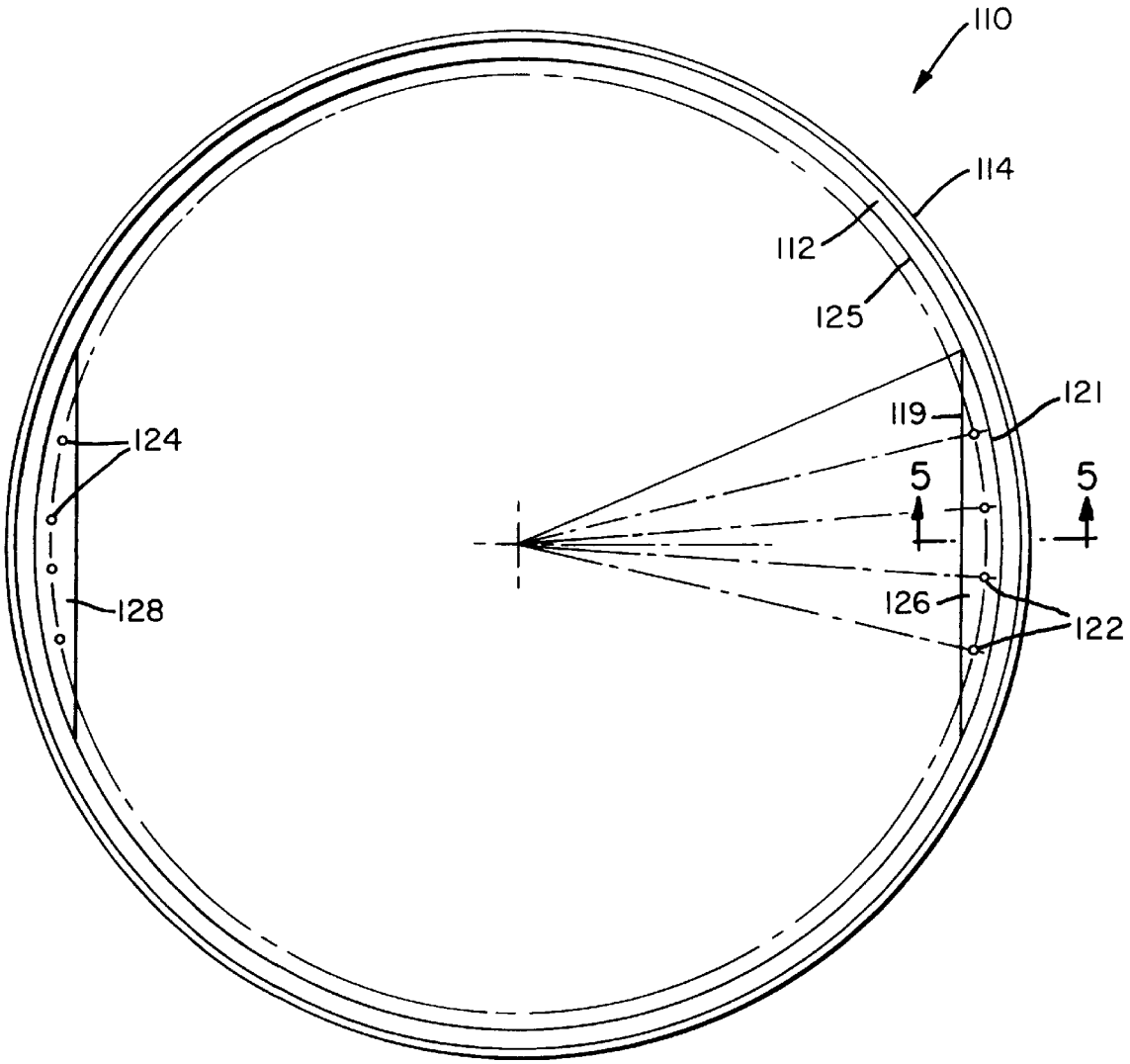
FIG. 4 is a front elevational view similar to that of FIG. 1 showing, however, the new and improved ring member constructed in accordance with the teachings and principles of the present invention.
Figure 6:
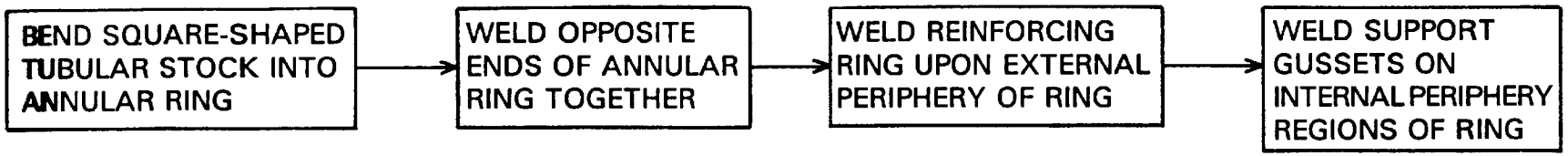
FIG. 6 is a flow chart showing the process steps of the method used to manufacture or fabricate the new and improved ring member as constructed in accordance with the principles and teachings of the present invention.

Referring again to the drawings, and more particularly now to FIGS. 4–6 thereof, the new and improved film carriage ring, constructed in accordance with the teachings and principles of the present invention, and adapted for use within horizontal stretch-type film wrapping or packaging machines is disclosed and is generally indicated by the reference character 110. It is to be noted that in connection with the detailed description of the new and improved film carriage ring 110 of the present invention, as compared to the conventional film carriage ring 10 of the known PRIOR ART as illustrated in FIGS. 1–3, corresponding parts of the film carriage rings will be designated by corresponding or similar reference characters except that the reference characters used to designate the various components parts of the film carriage ring 110 of the present invention will be in the 100 series.

Accordingly, it is appreciated that the film carriage ring 110 of the present invention primarily comprises an annular ring member 112 and an annular reinforcing ring 114 which is welded around the entire external periphery of the annular ring member 112 subsequent to the fabrication or manufacture thereof. More particularly, as can been appreciated from FIG. 5, the annular ring member 112 comprises a structural member which is tubular in form and, in effect, has a substantially rectangular or square-shaped box-type configuration. The tubular member comprises structural stock material of a predetermined length from which a particular length of such stock material can be severed so as to be used in connection with the fabrication or manufacture of the annular ring member 112.

In accordance with the fabrication or manufacture of the annular ring member 112, the substantially rectangular or square-shaped tubular stock material, having been cut to the particularly desired axial length for use in manufacturing or fabricating the annular ring member 112, is mounted within a suitable fixture, not shown, and bent into circular form whereupon the free ends of the tubular stock material are then welded together so as to form the annular ring member 112. It is therefore appreciated that the ring member 112, unlike the ring member 12 characteristic of the conventional or PRIOR ART ring members utilized within conventional or current horizontal-type stretch film wrapping or packaging machines, is and can be fabricated or manufactured from stock material in such a manner as to substantially eliminate the excessive amount of waste of material which is characteristic of the fabrication or manufacture of the conventional or PRIOR ART ring members 12 as disclosed in FIGS. 1–3. In addition, the use of the tubular stock, as opposed to solid rod stock, substantially reduces the weight of the resulting annular ring member while not compromising the structural strength of the ring member 112.

In order to provide the annular ring member 112 with additional requisite strength and rigidity attendant its use as a rotatable ring member within a horizontal stretch film wrapping or packaging machine, a steel plate or bar is welded around the entire external periphery 123 of the annular ring member 112 so as to serve as the annular reinforcing ring 114. In addition, as can be appreciated from both FIGS. 4 and 5, a pair of gussets or support plates 126 and 128, having substantially segment-like configurations as a result of a chord-wise edge portion 119 intersecting an arcuate section 121, are welded to diametrically opposed inner peripheral portions 125 of the annular ring member 112. A first one of the gusset or support plates 126 is provided with apertures 122 for accommodating fasteners, not shown, which will serve to mount the film roll carriage and dispensing assembly, also not shown, thereon and upon the annular ring member 112, and a second one of the gusset or support plates 128 is similarly provided with apertures 124 for accommodating fasteners, not shown, which will serve to mount a suitable device or mechanism thereon for counterbalancing the film roll carriage and dispensing assembly.

It is noted that the gussets or support plates 126 and 128 are welded to the inner peripheral portions 125 of the annular ring member 112 such that each gusset or support plate 126 and 128 is located axially centrally between forward and rearward surfaces or sides 130 and 132, respectively, of the annular ring member 112. It is also noted that the tubular stock from which the annular ring member 112 is fabricated is necessarily substantially square-shaped or rectangular-shaped in cross-section so as to provide the mounting surfaces upon which the reinforcing ring 114 and the gusset plates 126,128 can be readiuly mounted. If tubular stock having, for example, a circular cross-sectional configuration, was employed, fixation of the reinforcing ring 114 and the gusset plates 126,128 upon the ring member 112 would be difficult to achieve. In addition, it is further noted that while the method or processing flow chart of FIG. 6 illustrates or sets forth the fact that the reinforcing ring 114 is welded to the external periphery of the annular box-ring member 112 prior to the welding of the gusset support plates or member s 126,128 upon the internal peripheral portions of the box-ring member 112, the sequencing of these processing steps can of course be reversed.

Thus it may be seen that in accordance with the principles and teachings of the p resent invention, a new and improved annular ring member has been disclosed and is able to be manufactured or fabricated from tubular stock material in such a manner as to substantially eliminate the excessive amount of waste of material previously characteristic of the fabrication or manufacture of conventional or PRIOR ART ring members used in horizontal-type stretch film wrapping or packaging machines.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by: Letters Patent of the United States of America, is:

1. A composite ring member for mounting a film roll carriage and dispensing assembly thereon for rotation around a horizontal axis of a horizontal stretch-type film wrapping machine, comprising:

an annular ring member, upon which a roll of stretch-film wrapping material is to be mounted, comprising a tubular member having a predetermined length and bent into an annular ring with opposite ends thereof welded together, said annular ring member defining an axis about which said annular ring member is adapted to be rotated and comprising an external peripheral surface portion and an internal peripheral surface portion;

a reinforcing ring member fixedly secured to said external peripheral surface portion of said annular ring member;

a first gusset support plate fixedly secured to a first region of said inner peripheral surface portion of said annular ring member for mounting a film roll carriage and a film roll dispensing assembly thereon; and a second gusset support plate fixedly secured to a second region of said inner peripheral surface portion of said annular ring member, which is disposed diametrically opposite said first gusset support plate and said first region of said inner peripheral surface portion of said annular ring member, for mounting a mechanism for counterbalancing the film roll carriage and the film roll dispensing assembly mounted upon said first gusset support plate.

2. The composite ring member as set forth in claim 1, wherein:

said tubular member comprises tubular stock having a substantially rectangular cross-sectional configuration.

3. The composite ring member as set forth in claim 1, wherein:

said reinforcing ring member is welded to said external peripheral portion of said annular ring member.

4. The composite ring member as set forth in claim 2, wherein:

said reinforcing ring member is welded to an external peripheral side surface portion of said tubular member having said substantially rectangular cross-sectional configuration.

5. The composite ring member as set forth in claim 1, wherein:

said reinforcing ring member comprises a steel plate bent around and welded to said external peripheral portion of said annular ring member.

6. The composite ring member as set forth in claim 1, wherein:

said first gusset support plate is welded to said first inner peripheral portion of said annular ring member.

7. The composite ring member as set forth in claim 1, wherein:

said second gusset support plate is welded to said second inner peripheral portion of said annular ring member.

8. The composite ring member as set forth in claim 1, wherein:

said first and second gusset support plates are fixed to said first and second inner peripheral portions of said annular ring member at axially central positions along said first and second inner peripheral portions of said annular ring member.

9. The composite ring member as set forth in claim 1, wherein:

said first and second gusset support plates have substantially segmental configurations as defined by chord edge portions thereof intersecting arcuate portions thereof.

10. In a horizontal stretch-type film wrapping machine, a composite ring member for mounting a film roll carriage and dispensing assembly thereon for rotation around a horizontal axis of the horizontal stretch-type film wrapping machine, comprising:

an annular ring member, upon which a roll of stretch-film wrapping material is to be mounted, comprising a tubular member having a predetermined length and bent into an annular ring with opposite ends thereof welded together, said annular ring member defining an axis about which said annular ring member is adapted to be rotated and comprising an external peripheral surface portion and an internal peripheral surface portion;

a reinforcing ring member fixedly secured to said external peripheral surface portion of said annular ring member;

a first gusset support plate fixedly secured to a first region of said inner peripheral surface portion of said annular ring member for mounting a film roll carriage and a film roll dispensing assembly thereon; and a second gusset support plate fixedly secured to a second region of said inner peripheral surface portion of said annular ring member, which is disposed diametrically opposite said first gusset support plate and said first region of said inner peripheral surface portion of said annular ring member, for mounting a mechanism for counterbalancing the film roll carriage and the film roll dispensing assembly mounted upon said first gusset support plate.

11. The composite ring member as set forth in claim 10, wherein:

said tubular member comprises tubular stock having a substantially rectangular cross-sectional configuration.

12. The composite ring member as set forth in claim 10, wherein:

said reinforcing ring member is welded to said external peripheral portion of said annular ring member.

13. The composite ring member as set forth in claim 11, wherein:

said reinforcing ring member is welded to an external peripheral side surface portion of said tubular member having said substantially rectangular cross-sectional configuration.

14. The composite ring member as set forth in claim 10, wherein:

said reinforcing ring member comprises a steel plate bent around and welded to said external peripheral portion of said annular ring member.

15. The composite ring member as set forth in claim 10, wherein:

said first gusset support plate is welded to said first inner peripheral portion of said annular ring member.

16. The composite ring member as set forth in claim 10, wherein:

said second gusset support plate is welded to said second inner peripheral portion of said annular ring member.

17. The composite ring member as set forth in claim 10, wherein:

said first and second gusset support plates are fixed to said first and second inner peripheral portions of said annular ring member at axially central positions along said first and second inner peripheral portions of said annular ring member.

18. The composite ring member as set forth in claim 10, wherein:

said first and second gusset support plates have substantially segmental configurations as defined by chord edge portions thereof intersecting arcuate portions thereof.

19. A method of manufacturing a ring member for use within a horizontal-type stretch-film packaging machine, comprising the steps of:

cutting tubular stock, having a substantially rectangular cross-sectional configuration, to a predetermined length;

bending said tubular stock, cut to said predetermined length, into an annular ring member such that said annular ring member defines an axis about which said annular ring member can be rotated and wherein said annular ring member has external and internal peripheral surface portions defined thereon;

welding together opposite ends of said tubular stock bent into said annular ring member;

welding a reinforcing ring around said external peripheral portion of said annular ring member;

welding a first gusset plate upon a first region of said internal peripheral surface portion of said annular ring member for mounting a film roll carriage and film roll dispensing assembly of the packaging machine thereon; and welding a second gusset plate upon a second region of said internal peripheral surface portion of said annular ring member, which is disposed diametrically opposite said first region of said internal peripheral surface portion of said annular ring member, for mounting a mechanism for counterbalancing the film roll carriage and film roll dispensing assembly mounted upon said first gusset support plate.

20. The method as set forth in claim 19, further comprising the step of:

welding said first and second gusset plates to said first and second regions of said inner peripheral surface portion of said annular ring member at axially central positions along said first and second regions of said inner peripheral surface portion of said annular ring member.

21. The method as set forth in claim 19, further comprising the step of:

forming said first and second gusset support plates as substantially segmental members as defined by respective chord edge portions intersecting respective arcuate portions thereof.

* * * * *